United States Patent [19]

Neuner et al.

[11] 4,256,289

[45] Mar. 17, 1981

[54] CONVERTER ARRANGEMENT

[75] Inventors: Ludwig Neuner, Leonding; Friedrich Laimer, Perg, both of Austria

[73] Assignee: Voest-Alpine Aktiengesellschaft, Linz, Austria

[21] Appl. No.: 39,827

[22] Filed: May 17, 1979

[30] Foreign Application Priority Data

May 24, 1978 [AT] Austria ..... 3768/78

[51] Int. Cl.[3] ..... C21B 7/00

[52] U.S. Cl. ..... 266/159; 266/158

[58] Field of Search ..... 266/159, 158

[56] References Cited

U.S. PATENT DOCUMENTS

| | | | |
|---|---|---|---|
| 3,537,694 | 11/1970 | Rinesch | 266/159 |
| 3,809,376 | 5/1974 | Plazier | 266/159 |
| 3,844,769 | 10/1974 | Calderon | 75/60 |
| 3,938,788 | 2/1976 | Josten | 266/142 |
| 3,972,708 | 8/1976 | Baum | 75/60 |
| 4,035,179 | 7/1977 | Calderon | 75/60 |
| 4,049,246 | 9/1977 | Ziegler | 266/158 |
| 4,072,299 | 2/1978 | Calderon | 266/158 |
| 4,081,269 | 3/1978 | Nomine | 75/60 |
| 4,168,824 | 9/1979 | Nagati | 75/60 |

*Primary Examiner*—P. D. Rosenberg

*Attorney, Agent, or Firm*—Brumbaugh, Graves, Donohue & Raymond

[57] ABSTRACT

A converter arrangement includes a tiltable converter vessel surrounded by a casing on whose ceiling a principal discharge conduit for conducting away refining gases, and a secondary discharge conduit for conducting away the smoke forming during charging and pouring, are connected. One side wall of the casing has an opening closeable by a door. The casing is widened in the tilting direction of the converter and a car carrying a charging container is movable into the widened space through the opening in the side wall. The opening can be completely closed when the car is in the moved-in position during charging and pouring off.

6 Claims, 2 Drawing Figures

CONVERTER ARRANGEMENT

BACKGROUND OF THE INVENTION

The invention relates to a converter plant including a tiltable converter vessel surrounded by a casing on whose ceiling a principal discharge conduit for conducting away refining gases, and a secondary discharge conduit for conducting away the smoke forming during charging and pouring off, respectively, are connected. One side wall of the casing comprises an opening that is closeable by a door.

When operating a converter of a steel-making plant, flue gases escape from the converter mouth during refining, which gases mainly include carbon oxides and FeO-particles carried away therewith. These flue gases, also referred to as principal emissions, have to be purified, and possibly also the energy contained therein has to be regained, before the gases are allowed to be let off into the atmosphere. Also during charging of a converter with scrap and pig iron, and during tapping of the liquid steel into the casting ladle, smoke, which is sometimes heavy, will develop, which smoke is flue gases called additional emissions or secondary flue gases. An even greater nuisance from the development of smoke and fume is caused in steel-making plants with bottomblowing converters, e.g. when carrying out the OBM-method, since the introduction of auxiliary agents into the bottom valves causes spatters in the form of showers of sparks.

In recent times, and in more developed industrial countries, there exist stringent regulations as to the prevention and reduction of the emissions, as well as regulations for improving the safety of the operating personnel. The known installations for conducting away secondary flue gases do not meet these demands. These known arrangements, which are designed as hoods arranged in front of the converter mouth and connected to discharge conduits, are not able to reliably take up the secondary gases.

An arrangement of the initially-defined kind, a so-called "doghouse", has also become known (German Offenlegungsschrift No. 22,33,443) in which a converter of a steel-making plant is installed in a casing that leaves free a sight distance on all sides but which however, allows for tilting movements.

Charging of the converter, in this case, takes place through a charging opening provided in a side wall of the casing, in which opening the lip of a charging ladle or a charging trough are introduceable. During charging, the charging opening remains open, and therefore the noxious substances of the secondary emissions are not prevented from escaping through the charging opening so as to reach the atmosphere and endanger the safety of the personnel. This danger is particularly present with OBM-converters when feeding the bottom valves.

SUMMARY OF THE INVENTION

The invention aims at avoiding the descibed disadvantages and difficulties and has as its object to provide a converter arrangement that guarantees a complete encasing of the sources and parts of the arrangement causing the flue gases and emissions, without impeding the sequence of operation.

With a plant of the described kind, this object is achieved in that the casing is widened in the tilting direction of the converter, into which widened space a car carrying a charging container, e.g. a casting ladle, is movable through an opening in the side wall of the casing. The opening is completely closeable when the car is in the position during charging and pouring. The door for closing the opening can be designed as a sliding door, preferably in two parts.

Depending on the space occupied by the charging container during the tilting movement, the widened space can be made higher than the remaining space surrounding the converter and a secondary discharge conduit can be attached at the highest point of the casing.

Further preferred characteristics of the plant according to the invention relate to a common filter arrangement provided for the principal discharge conduit and the secondary discharge conduit, a charging car equipped with mechanical or hydraulic lifting means for tilting the charging container, or a rope elevator for tilting of the charging container provided at the ceiling of the casing in the region of the widened space.

BRIEF DESCRIPTION OF THE DRAWINGS

The invention will now be described in more detail with reference to the accompanying drawing, wherein.

DESCRIPTION OF EXEMPLARY EMBODIMENTS

Figure 1:
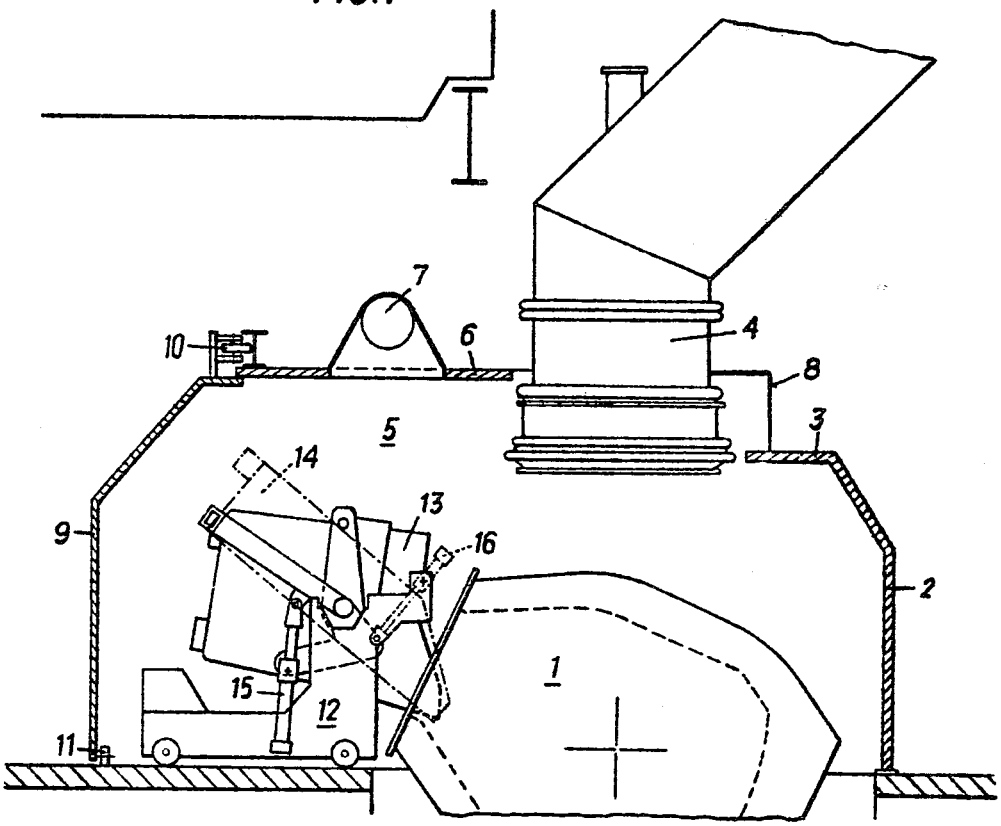
FIGS. 1 and 2 each show a side view of two alternative embodiments of a casing for a converter plant with one side wall of the casing being removed.

At the converter stand illustrated in FIG. 1, a converter surrounded on all sides by a casing 2 which is closed from above by a ceiling 3. Above the mouth of the converter, if the latter is in an upright blowing position, is the principal discharge conduit, flue 4, leading to a filter arrangement. According to the invention, the casing is widened in the tilting direction of the converter - the converter in FIG. 1 is illustrated in the tilted position -, to form a widened space 5 closed from above by a ceiling part 6, which may be arranged higher than the ceiling part 3.

A secondary discharge conduit 7 is connected to the highest point. A top part on the casing 2, denoted by 8, forms the transition from ceiling 3 to the elevated ceiling part 6 of the widened space 5. In the wall of the casing opposite the back wall, an opening is provided which is closeable by a door 9. This door can be designed as a one or two-part sliding door and is guided on rollers 10 of a carrier at the ceiling of the casing and on rollers 11 on the bottom. As can be seen from the drawing, a car 12 is movable through the opened door into the widened space 5. This car can accommodate a charging container, e.g. a pig iron ladle 13 or a scrap chute 14. Hydraulic tilting devices each pertaining thereto are denoted by 15 and 16.

Figure 2:
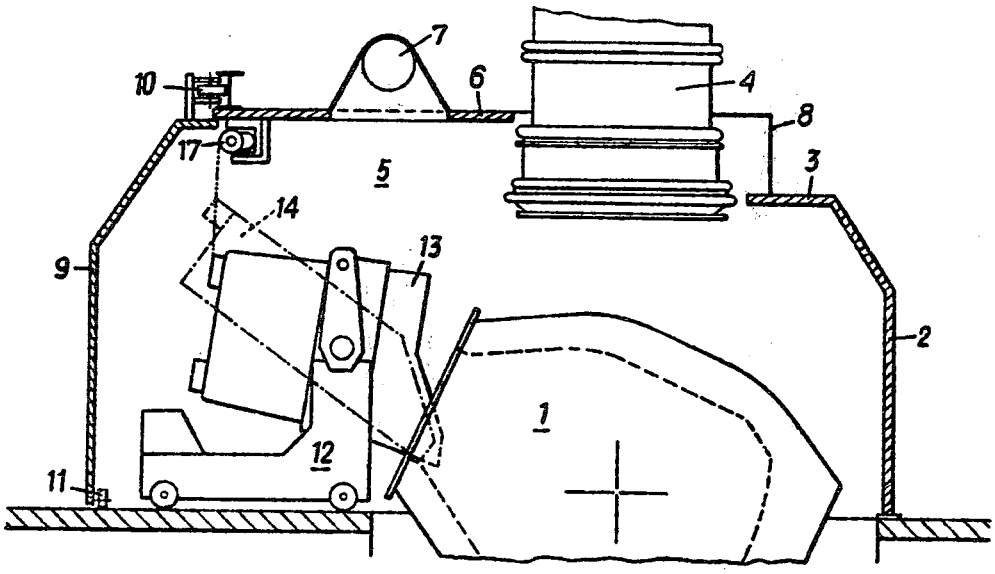

The arrangement according to FIG. 2 substantially corresponds to that of FIG. 1, the only difference being that instead of the hydraulic tilting devices 15, 16, a rope elevator 17 is attached to the ceiling 6, by which tilting of the charging container is effected.

The arrangement operates in a manner such that at first scrap is charged into the converter when it is in the tilted position. For this purpose the loaded scrap chute is placed onto the charging car outside the casing by means of a scrap manipulation crane and the charging car is moved into the charging position with the door opened. Then the door is closed and the tilting procedure is initiated. The smoke emerging during charging collects below the ceiling 6 and is conducted away and exhausted through the principal discharge conduit 4 and the secondary discharge conduit 7. Then the charging car is moved out and loaded with a pig iron ladle. Charging of the converter with liquid pig iron is carried out in the same manner. During charging the door remains closed and the converter stand is completely sealed off from the hall. Also during subsequent refining in the upright position of the converter, the door remains closed, so that no spatters, showers of sparks or the like will reach the hall. As soon as the refining procedure is terminated, the steel is poured into ladles. During the pouring phase, the principal discharge conduit can be turned off. The smoke that forms is collected in the space below the ceiling 6 and is conducted away through the secondary discharge conduit 7. The door 9, in this case, remains closed.

What we claim is:

1. In a converter arrangement of the type including a tiltable converter vessel, a casing surrounding said tiltable converter vessel and having a ceiling and side walls, a principal discharge conduit for conducting away refining gases, and a secondary discharge conduit for conducting away smoke forming during charging and pouring off, said secondary discharge conduit being connected to said ceiling, one of said side walls of said casing having an opening to permit charging of the vessel and a door provided for closing said opening, the improvement which is characterized in that said casing is widened in the tilting direction of said tiltable converter vessel so as to form a widened space sufficient to permit a car carrying a charging container to be movable into said widened space through said opening at a height for charging said container, and said opening is completely closeable during charging and pouring off, when said car has been moved into said widened space.

2. A converter arrangement as set forth in claim 1, wherein said widened space is higher than the remaining casing surrounding said tiltable converter vessel, and wherein said secondary discharge conduit is connected at the highest point of said casing.

3. A converter arrangement as set forth in claim 1, wherein a common filter arrangement is provided for said principal discharge conduit and said secondary discharge conduit.

4. A converter arrangement as set forth in claim 1, wherein mechanical lifting means are arranged at said car for tilting said charging container.

5. A converter arrangement as set forth in claim 1, wherein hydraulic lifting means are arranged at said car for tilting said charging container.

6. A converter arrangement as set forth in claim 1, wherein a rope elevator for tilting said charging container is provided at said ceiling of said casing in the region of said widened space.

* * * * *